US005863361A

United States Patent [19]

Bucher

[11] Patent Number: 5,863,361

[45] Date of Patent: Jan. 26, 1999

[54] METHOD FOR STECKEL MILL OPERATION

[75] Inventor: John H. Bucher, Spring City, Pa.

[73] Assignee: Pennock Corporation, Wilmington, Del.

[21] Appl. No.: 848,751

[22] Filed: May 1, 1997

[51] Int. Cl.[6] ..... C21D 8/02

[52] U.S. Cl. ..... 148/602; 148/654

[58] Field of Search ..... 148/602, 654, 148/657

[56] References Cited

U.S. PATENT DOCUMENTS 4,898,629 2/1990 Lang et al. ..... 148/602

FOREIGN PATENT DOCUMENTS 404325626 11/1992 Japan ..... 148/602

OTHER PUBLICATIONS

Lin et al., "Effects of Run–Out Table Cooling Profile on the Mechanical Properties of C–Mn and C–Mn–Nb–V Steels," 37th MWSP Conf. Proc., ISS, vol. XXXIII, 1996, pp. 79–88.

Nelson et al., "The Effect of Runout Table Cooling Trajectories on the Properties of Low–C, Medium–C and HSLA Steels," 34th MWSP Conf. Proc., ISS–AIME, vol. XXX, 1993, pp. 53–60.

Takawa et al., "Mathematical Model and Control System of Cooling Process," The Sumitomo Search No. 34, May 1986, pp. 79–87.

Kunishige et al., "Microstructures and Mechanical Properties of High Strength Steel Sheets Taking Full Advantage of Thermomechanical Treatment on Hot Strip Mills," The Sumitomo Search No. 31, Nov. 1985, pp. 53–62.

Fukagawa et al., "Mechanism of Red Scale Defect Formation in Si–added Hot–rolled Steel Sheets," ISIJ 1994, pp. 906–911.

Okada et al., "Prevention of Red Scale Formation during Hot Rolling of Steels," ISIJ 1995, pp. 886–891.

*Primary Examiner*—Deborah Yee

*Attorney, Agent, or Firm*—Finnegan, Henderson, Farabow, Garrett & Dunner

[57] ABSTRACT

A method is provided for Steckel mill rolling and finishing flat rolled steel having uniform mechanical properties, good surface quality, and ease of flattening whether in coil form or discrete sheet or plate by hot rolling a heated transfer bar in a Steckel mill and reverse rolling and optional coiling to achieve finished flat rolled product of a selected thickness and selected austenite finishing temperature. The finished product is water cooled to a ferrite transformation temperature and thereafter air cooled until transformation from austenite to ferrite is at least 70% completed. The product may be further water cooled to a temperature below the ferrite transformation temperature.

10 Claims, 1 Drawing Sheet

METHOD FOR STECKEL MILL OPERATION

BACKGROUND OF THE INVENTION

1. Field of the Invention

The invention relates to a method for Steckel mill rolling and finishing to produce hot-rolled flat steel products.

2. Brief Description of the Prior Art

Hot-rolled flat steel product is conventionally produced either by the use of a continuous hot strip mill or a reversing hot strip mill, known as a Steckel mill.

With a continuous hot strip mill, a heated transfer bar, such as a slab rolled on a roughing mill, is introduced to a series of in-line rolling stands, each having work rolls that produce a hot rolled flat product of the desired finished gauge. The flat product after completion of hot rolling is then subjected to cooling before coiling.

Although continuous hot strip mills are desired for high tonnage strip requirements and where the length of the rolling line is not of significance, for low tonnage applications, and where a relatively short rolling line is significant, the reversing hot rolling capability of the Steckel mill is of preferred use. In addition, a Steckel mill may be selectively used in the production of flat rolled products of thicker gauge, such as discrete plate rather than lighter gauge products such as sheet and strip produced in coil form.

A Steckel mill consists principally of a single reversing mill roll stand with a hot coiling furnace positioned on both the entry and exit side of the mill. The mill receives a transfer bar of approximately the same dimensions as that which would be used in the finishing roll stands of a continuous mill. During the rolling operation, the product is subjected to a sequential operation of coiling and uncoiling from the hot coiling furnaces of the Steckel mill until the desired reduction has been achieved.

The hot rolled product is then deflected onto a run out table where it is subjected to cooling prior to coiling. Alternately, in the production of thicker gauge flat rolled products, the transfer bar may be subjected to a series of reverse rolling processes through the Steckel mill with or without employing the hot coiling furnaces of the mill and the steel after cooling is produced as discrete plate rather than being coiled.

Where the length of the combined rolling and finishing line is significant, it is advantageous to reduce the size of the run-out table to less than 150 feet and yet complete the desired finishing operations, particularly cooling, to achieve the desired microstructure and physical and mechanical properties in the finished flat rolled product. This is not possible with conventional cooling practices employed in association with a Steckel mill having a run-out table this short.

It is accordingly an object of the present invention to provide a method for Steckel mill rolling and finishing of hot rolled flat steel products wherein the length of the finishing line necessary to achieve the required cooling may be made shorter than with conventional cooling practices used with both continuous hot strip mills and Steckel mills.

SUMMARY OF THE INVENTION

In accordance with the broadest aspects of the invention, a method is provided for Steckel mill rolling and finishing flat rolled steel having uniform mechanical properties, good surface quality, and ease of flattening, whether in coil form or discrete sheet or plate. This is achieved in accordance with the invention by hot rolling a heated transfer bar in a Steckel mill by reverse rolling and optional coiling to achieve finished flat rolled product of a selected thickness and selected finishing temperature. This product, which is fully austenitic, is then water cooled to a ferrite transformation temperature and thereafter air cooled until transformation from austenite to ferrite is at least 70% completed. If the steel is characterized by a relatively low content of residual constituents, the air cooled flat rolled product may be further water cooled to a temperature below the ferrite transformation range. In either instance, the flat rolled product may be coiled after runout table cooling where transformation is completed to at least 60% ferrite, preferably at least 70%.

The finishing temperature in accordance with the invention may be about 1400° to 1650° F., preferably 1550° F., the ferrite transformation temperature may be between 1100° F. and 1200° F. with the coiling temperature or water end temperature for discrete plate being about 1050° F., with strip having a relatively low residual constituent content.

The water cooling and air cooling may be performed on a short run out table.

The term "short run out table" as used herein means a run out table that is not of sufficient length to effect transformation from austenite to at least 70% ferrite by a combination of gradual water cooling followed by air cooling and optional coiling.

The term "gradual water cooling" as used herein means essentially uniform cooling at a rate of about 15° F./sec. on the run-out table.

The term "transfer bar" as used herein means the "workpiece" when finish rolling thereof on the Steckel mill begins especially but not only if the workpiece has been rolled on a roughing mill.

The term "residual constituents" as used herein means such elements as Cu, Ni, Cr and Mo which tend to produce a complex oxide scale on the steel which oxide is retentive.

The accompanying drawing, which is incorporated in and constitutes a part of this specification, illustrates one embodiment of the present invention and together with the description, serves to explain the principles of the present invention.

BRIEF DESCRIPTION OF THE DRAWING

The single FIGURE drawing is a transformation diagram for the cooling of flat rolled steel in accordance with a practice of the invention.

DESCRIPTION OF THE PREFERRED EMBODIMENT

Figure 1:
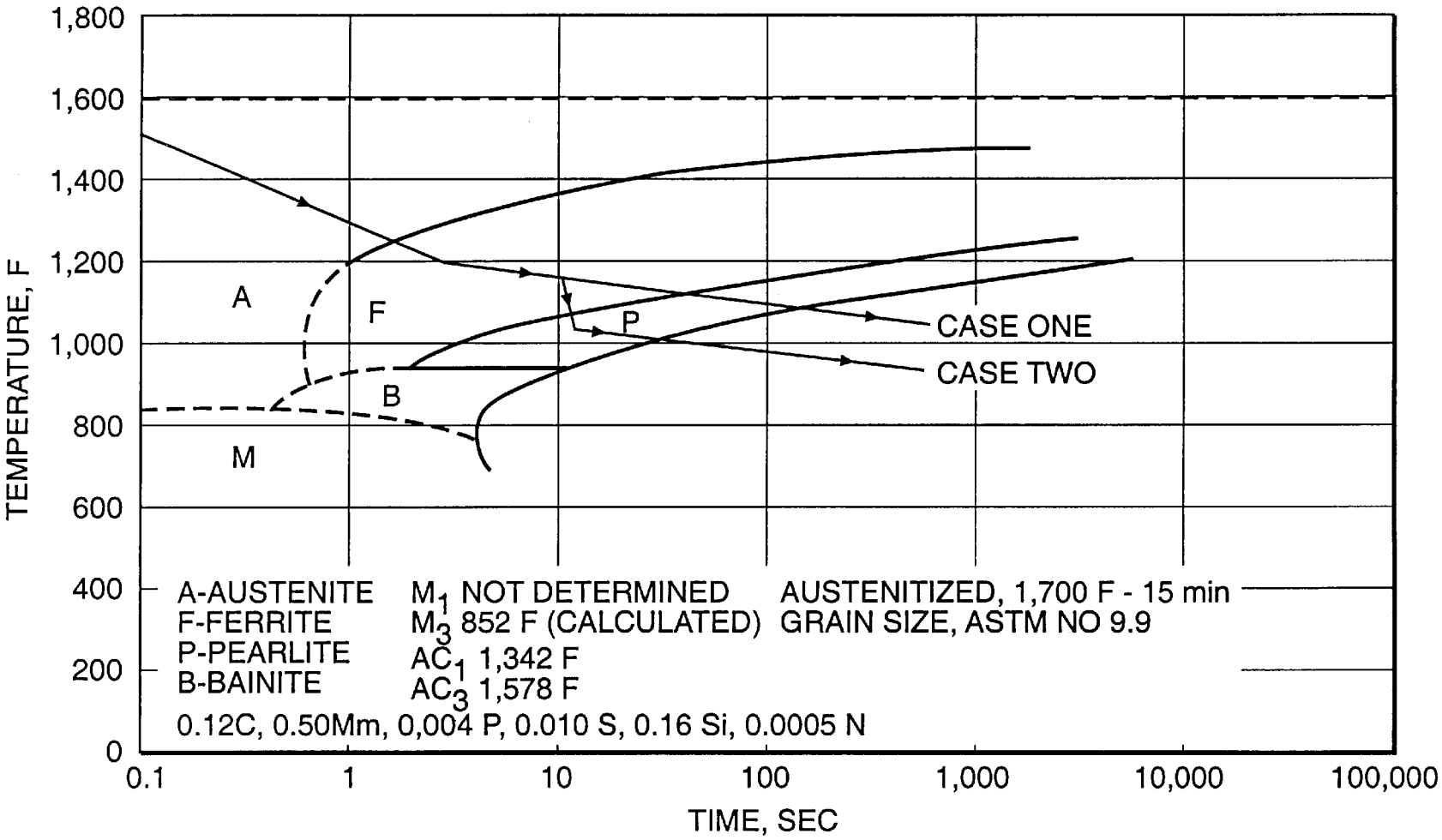

With reference to the single figure of the drawing, the transformation diagram thereof indicates the time at temperature profile for the cooling of finished flat rolled steel from a finishing temperature of 1550° F. at which the steel is fully austenitic.

The steel is then subjected to water cooling sprays on a run out table constituting a first cooling operation to a ferrite transformation temperature of about 1100° F. to 1200° F. The steel is then air cooled to complete the transformation from austenite to ferrite and pearlite (case one). If the residual element content of the steel is relatively low, e.g., less than about 0.20%, the strip is subjected to a second water cooling step to a temperature of 1050° F. (case two) to minimize the formation of excessive flaky scale.

As may be seen from the transformation diagram, the practice of the invention provides an efficient austenite to ferrite cooling practice that minimizes the required length of the run-out table over run-out tables of increased lengths used with continuous hot strip mills and Steckel mills using conventional cooling practices.

The following tables constitute specific examples of the practice of the invention with respect to both two-stage and three-stage cooling practices:

CASE ONE: Two-stage cooling of a .22% C., .40% Mn steel rolled to .385" thickness.

| Example | Finishing Temperature (°F.) | Air Cooling Time* (seconds) | Water Cooling Time (seconds) | Ferrite Transformation Temperature (°F.) | Air Cooling Time** (seconds) | Coiling Temperature (°F.) | % Ferrite |
|---|---|---|---|---|---|---|---|
| 810181 | 1421 | 7 | 7.5 | 1145 | 10.7 | 1139 | 77 |
| 810188 | 1494 | 7 | 9.5 | 1153 | 8.8 | 1145 | 79 |
| 810191 | 1541 | 7 | 8.4 | 1159 | 9.8 | 1148 | 81 |
| 813008 | 1482 | 7 | 6.7 | 1132 | 11.5 | 1128 | 75 |
| 813009 | 1444 | 7 | 6.7 | 1153 | 11.5 | 1142 | 78 |

*occurs over the distance of 34 feet from the mill stand to the beginning of the water cooling section which is 74 feet in length.
**occurs partially in the water cooling section and in the section of rolls between the end of the water cooling section and the coiler which is 18 feet.

Case Two: Three-stage cooling of a .09% C., .60% Mn steel rolled to 0.25", 0.312" and 0.375" thickness

| Example | Finishing Temp. (°F.) | Air Cooling Time* (sec.) | Water Cooling Time (sec.) | Ferrite Transformation Temperature (°F.) | Air Cooling Time** (sec.) | Water Cooling Time (sec.) | Coiling Temp. (°F.) | % Ferrite |
|---|---|---|---|---|---|---|---|---|
| 810402 (.25") | 1489 | 7 | 5.8 | 1130 | 5.8 | 3 | 1059 | 80 |
| 808976 (.312") | 1605 | 7 | 6.7 | 1160 | 4.2 | 2.4 | 1150 | 84 |
| 811182 (.312") | 1483 | 7 | 6.2 | 1152 | 4.4 | 3.9 | 1079 | 81 |
| 811225 (.312") | 1562 | 7 | 6.2 | 1151 | 4.5 | 4 | 1008 | 80 |
| 811181 (.375") | 1502 | 7 | 6.2 | 1145 | 4.6 | 3.9 | 1040 | 81 |

*occurs over the distance of 34 feet from the mill stand to the beginning of the water cooling section which is 74 feet in length.
**occurs partially in the water cooling section and in the section of rolls between the end of the water cooling section and the coiler which is 18 feet.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for hot Steckel mill rolling and finishing flat rolled steel having uniform mechanical properties, good surface quality and ease of flattening, whether in coil form or discrete sheet or plate, comprising hot rolling a heated transfer bar in a Steckel mill by reverse rolling and optional coiling to achieve finished flat rolled product of a selected thickness and selected austenite finishing temperature prior to any coiling of said finished flat rolled product, water cooling said finished, flat rolled product to a selected ferrite transformation temperature, and thereafter air cooling said finished flat rolled product until transformation from austenite to ferrite is at least 60% completed prior to any coiling thereof.

2. The method of claim 1, wherein said air cooled finished flat rolled product is further water cooled to a temperature below said selected ferrite transformation temperature prior to any coiling.

3. The method of claim 1 or 2, wherein said finished flat rolled product is coiled after runout table cooling.

4. The method of claim 1 or 2, wherein said finished flat rolled product is not coiled after final cooling.

5. The method of claim 1 or 2, wherein said finishing temperature is about 1400°–1650° F.

6. The method of claim I or 2, wherein said finishing temperature is about 1550° F.

7. The method of claim 4, wherein said selected ferrite transformation temperature is 1100° to 1200° F.

8. The method of claim 2, wherein said finished flat rolled product is further water cooled to a temperature of about 1050° F.

9. The method of claim 1 or 2, wherein said water cooling and said air cooling are performed on a short run-out-table.

10. The method of claim 1 or 2, wherein said transformation from austenite to ferrite is at least 70% completed.

* * * * *